United States Patent [19]

Inaba et al.

[11] Patent Number: 4,715,796

[45] Date of Patent: Dec. 29, 1987

[54] SCROLL-TYPE FLUID TRANSFERRING MACHINE WITH LOOSE DRIVE FIT IN CRANK SHAFT RECESS

[75] Inventors: Tsutomu Inaba; Tadashi Kimura; Norihide Kobayashi; Masahiro Sugihara; Tetsuzo Matsugi, all of Wakayama, Japan

[73] Assignee: Mitsubishi Denki Kabushiki Kaisha, Tokyo, Japan

[21] Appl. No.: 842,235

[22] Filed: Mar. 21, 1986

[30] Foreign Application Priority Data

| | | | |
|---|---|---|---|
| May 16, 1985 | [JP] | Japan | 60-106318 |
| May 16, 1985 | [JP] | Japan | 60-106307 |
| Nov. 27, 1985 | [JP] | Japan | 60-268436 |

[51] Int. Cl.[4] ..... F01C 1/04; F01C 17/06; F01C 21/02

[52] U.S. Cl. ..... 418/55; 418/57

[58] Field of Search ..... 418/55, 57; 29/156.4 R

[56] References Cited

U.S. PATENT DOCUMENTS

| | | | |
|---|---|---|---|
| 3,874,827 | 4/1975 | Young | 418/57 |
| 3,884,599 | 5/1975 | Young et al. | 418/55 |
| 4,065,279 | 12/1977 | McCullough | 418/55 |

FOREIGN PATENT DOCUMENTS

| | | | |
|---|---|---|---|
| 2428228 | 10/1973 | Fed. Rep. of Germany . | |
| 2225327 | 1/1977 | Fed. Rep. of Germany . | |
| 3404222 | 9/1984 | Fed. Rep. of Germany . | |
| 55-46046 | 3/1980 | Japan | 418/57 |
| 57-151093 | 9/1982 | Japan | 418/55 |
| 58-28433 | 6/1983 | Japan . | |
| 59-103981 | 6/1984 | Japan | 418/55 |
| 59-120794 | 7/1984 | Japan | 418/55 |
| 59-162383 | 9/1984 | Japan . | |

*Primary Examiner*—John J. Vrablik

*Attorney, Agent, or Firm*—Oblon, Fisher, Spivak, McClelland, & Maier

[57] ABSTRACT

A scroll-type fluid transferring machine comprises a stationary scroll member and an oscillatable scroll member, each of which has a spiral wrap of an involute curve or other curves projecting from a base plate and which cooperate to form a compression chamber between the spiral wraps and the base plates by mutually fitting one into the other, an oscillatable scroll shaft provided on the surface of the base plate at the position opposite the spiral wrap of the oscillatable scroll member, a crank shaft having an eccentric recess having its axis which is shifted by a predetermined distance from the axis of the crank shaft, wherein a cylindrical bush having the coaxial outer and inner circles is loosely fitted in the eccentric recess of the crank shaft with a gap between the outer circumference of the bush and the inner wall of said eccentric recess, and the shaft of the oscillatable scroll member is fitted in the inner circumference of the bush in a freely rotatable manner.

6 Claims, 25 Drawing Figures

FIGURE 11 (b) PRIOR ART
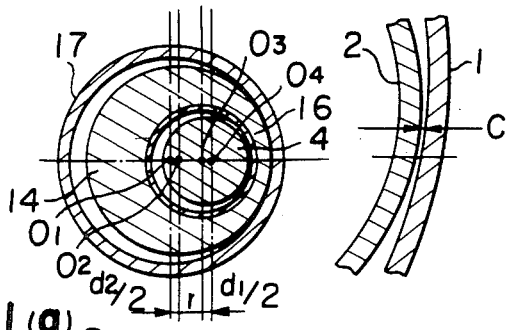
FIGURE 11 (a)
PRIOR ART
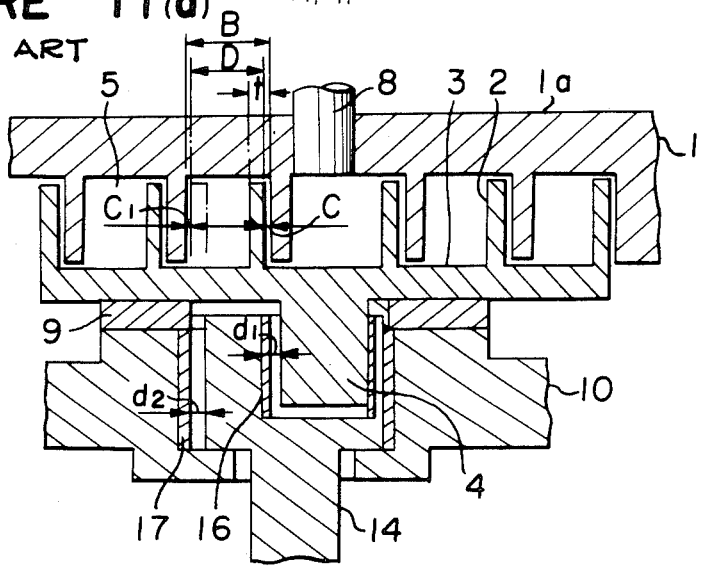
FIGURE 12
PRIOR ART
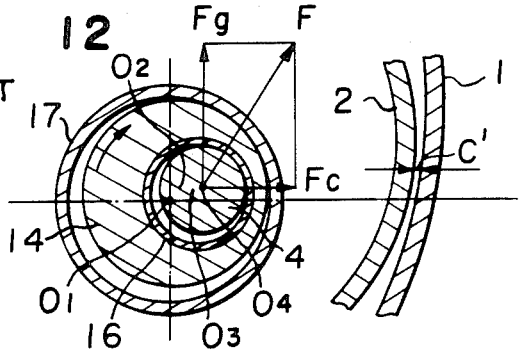

FIGURE 14 (a) PRIOR ART
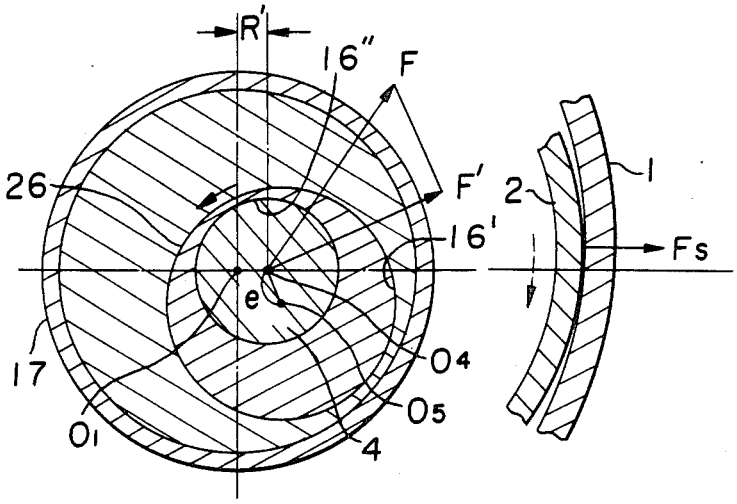
FIGURE 14 (b) PRIOR ART
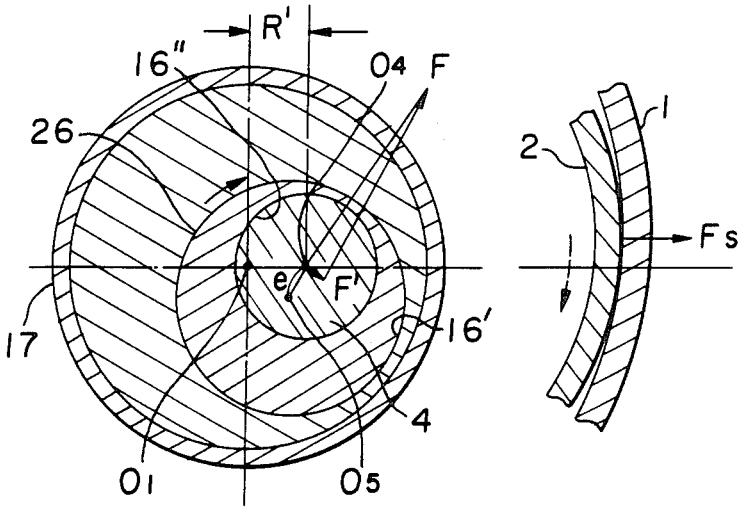

SCROLL-TYPE FLUID TRANSFERRING MACHINE WITH LOOSE DRIVE FIT IN CRANK SHAFT RECESS

BACKGROUND OF THE INVENTION

1. Field of the Invention

The present invention relates to a scroll-type fluid transferring machine which is used as an air compressor, a refrigerant compressor or an expansion machine.

2. Description of the Prior Art

The construction and function of a conventional scroll-type fluid transferring machine will be described with reference to FIGS. 9 to 14.

FIG. 9 shows the principle of a scroll-type fluid transferring machine. In the Figure, a reference numeral 1 designates a stationary scroll member, a numeral 2 designates an oscillatable scroll member, a numeral 5 designates a compression chamber formed between the wraps of the stationary and oscillatable scroll members 1, 2, a numeral 6 designates an intake chamber, and a numeral 8' designates a discharge chamber formed at the innermost part of the both scroll members. A symbol O indicates the center of the stationary scroll member 1. The stationary and oscillatable scroll members 1, 2 have the same spiral wrap of an involute of a circle or combination of the other suitable curved configuration. They are assembled with face-to-face and 180° shifted condition to thereby form the compression chamber between the wraps of the scroll members. In the above-mentioned condition, the oscillatable scroll member 2 is subjected to an oscillating movement as shown in FIGS. *9a–9d* in which the oscillatable scroll member moves around the center of the stationary scroll member 1 without movement of rotation, namely, a posture in angle of the scroll member 2 is fixed. With such oscillating movement, the volume of the compression chamber 5 is gradually reduced and a fluid introduced from the intake chamber 6 is discharged through the discharge chamber 8' at the center of the stationary scroll member 1.

FIG. 10 shows a conventional scroll-type compressor disclosed in Japanese Unexamined Patent Publication No. 103981/1984. The compressor is to compress gas such as freon and is used for refrigeration, air conditioning or an air compressor. In FIG. 10, a reference numeral 1 designates a stationary scroll member, a numeral 1*a* a base plate for the stationary scroll member 1, which constitutes a part of a shell as described below, a numeral 2 an oscillatable scroll member, a numeral 3 a base plate of the oscillatable scroll member 2, a numeral 4 a shaft of the oscillatable scroll member 2, a numeral 5 a compression chamber, a numeral 6 an intake chamber of the compression chamber 5, a numeral 7 an intake port, a numeral 8 an outlet port, a numeral 8' a discharge chamber, a numeral 9 a thrust bearing for supporting the back surface of the base plate 3 of the oscillatable scroll member 2, a numeral 10 a bearing supporter fixed to the stationary scroll member 1 by means of bolts and so on, a numeral 11 an Oldham's coupling which prevents movement of rotation and causes movement of oscillation of the oscillatable scroll member 2, a numeral 12 an Oldham's chamber formed between the base plate 3 of the oscillatable scroll member 2 and the bearing supporter 10, a numeral 13 an oil returning port formed in the bearing supporter 10 to communicate the Oldham's chamber 12 with a motor chamber 25 which is described below, a numeral 14 a crank shaft for driving the oscillatable scroll member 2, a numeral 15 an oil passage formed eccentrically in the crank shaft 14, a numeral 16 a bearing portion for oscillating movement which is formed eccentrically in the crank shaft 14 and receives the shaft 4 of the oscillatable scroll member, a numeral 17 a main bearing which fittingly receives the upper part of the crank shaft 14, a numeral 18 a bearing provided at the lower side of a motor which supports the lower part of the crank shaft 14, a numeral 19 a stator of the motor, a numeral 20 a rotor of the motor, a numeral 21 a first balancer firmly connected to the crank shaft 14 at the upper part of the rotor 20, a numeral 22 a second balancer firmly connected to the crank shaft 14 at the lower part of the rotor 20, a numeral 23 a shell which includes the stationary scroll member 1, the bearing supporter 10, the stator 19 of the motor and the bearing 18 at the side lower of the motor and which seals the entirety of the compressor, a numeral 24 designates oil stored in an oil reservoir in the bottom of the shell 23, and a numeral 25 designates the motor chamber containing the stator 19, the rotor 20 and so on.

The operation of the scroll-type compressor having the construction as above-mentioned will be described. When a current is supplied to coils of the stator 19, a torque is produced in the rotor 20, and the rotor 20 is rotated with the crank shaft 14. The rotation of the crank shaft 14 transmits the torque to the shaft 4 of the oscillatable scroll member 2 fittingly engaged with the bearing portion 16 of oscillating movement which is formed eccentrically in the crank shaft 14, whereby the oscillatable scroll member 2 is subjected to movement of oscillation by means of the Oldham's coupling 11 as a guide to perform a compressing function as shown in FIGS. *9a–d*.

In the movement of the scroll members, gas sucked into the intake chamber 6 formed at the outer circumferential part of the oscillatable scroll member 2 through the intake port 7 is confined in the compression chamber 5. The gas is supplied to the inside of the scroll member as the crank shaft 14 rotates and is discharged through the outlet port 8 formed at the center of the stationary scroll member 1. The movement of oscillation of the oscillatable scroll member 2 is apt to cause vibration of the compressor itself by unbalance in rotation of the crank shaft 14. For the purpose of preventing the undesired vibration, the first and second balancers 21, 22 are attached to the crank shaft 14 to balance the rotation of it, thereby providing normal operation of the compressor without causing abnormal vibration.

FIGS. 11–12 show important parts of the compressor in detail. FIG. 11*a* is a longitudinal cross-sectional view of the oscillatable scroll shaft 4, the crank shaft 14 and a part of the wraps of the stationary and oscillatable scroll members in the condition that the oscillatable scroll shaft 4 is pushed to the bearing portion of oscillating movement 16 due only to the centrifugal force acting on the oscillatable scroll member 2 and the base plate 3 without compressing gas. FIG. 11*b* is a transversal cross-sectional view of the part shown in FIG. 11*a*.

In the drawings, a symbol $O_1$ designates the center of the main bearing 17, a symbol $O_2$ desigantes the center of the crank shaft 14, a symbol $O_3$ designates the center of the bearing portion 16 of movement of oscillation, a symbol $O_4$ designates the center of the oscillatable scroll shaft 4, symbols FC designates a centrifugal force acting on the oscillatable scroll member 2 and the base plate 3 and so on, a symbol r designates the quantity of eccentricity of the bearing portion 16 of the movement of oscillation to the crank shaft 14, a symbol $d_1$ designates a gap formed between the bearing portion 16 and the outer circumference of the oscillatable scroll shaft 4, a symbol $d_2$ designates a gap formed between the inner surface of the main bearing 17 and the outer circumference of the crank shaft 14, a symbol B designates a width of the groove between the wrap of the stationary scroll member 1, a symbol t designates the thickness of the wrap of the oscillatable scroll member 2, and symbols C and $C_1$ designate gaps formed between the wraps of the stationary and oscillatable scroll members 1, 2, the gaps being generally in a relation of $C=C_1$.

In the conventional scroll-type compressor, the actual width D of the oscillatable scroll member 2 is expressed as follows:

$$D = 2(r + d_1^{\frac{1}{2}} + d_2^{\frac{1}{2}}) + t \quad (1)$$
$$= 2r + t + d_1 + d_2$$

Accordingly, the gap C in the radial direction between the wraps of the stationary and oscillatable scroll members 1, 2 can be given as follows;

$$C = (B - D)/2 \quad (2)$$
$$= [B - (2r + t + d_1 + d_2)]/2$$
$$= [(B - 2r - t) - (d_1 + d_2)]/2$$

In the conventional scroll-type compressor, determination has been made in such a manner that in the equation (2), $(B-2r-t)$ is greater than $(d_1+d_2)$. Therefore, the gap C in the radial direction is always formed between the wraps of the stationary and oscillatable scroll members 1, 2. Further, a load Fg for compressing gas acts on the oscillatable scroll shaft 4 in the direction perpendicular to the centrifugal force FC in addition to the centrifugal force in a state of normal operations as shown in FIG. 12, a resultant force F by composing the both forces Fg and FC is produced in the direction as shown in FIG. 12, whereby the oscillatable scroll shaft 4 is pushed to the direction of the resultant force F. Accordingly, the gap C' in the radial direction between the wraps of the stationary and oscillatable scroll members 1, 2 in the above-mentioned state becomes greater than the gap C in the radial direction in the state that only the centrifugal force FC exists. Thus, when the gap C or C' in the radial direction between the wraps is produced, there takes place no contacting state of the wraps of the stationary and oscillatable scroll members 1, 2 during the operation of the compressor. In this case, although a problem of wearing of the side surfaces of the wraps does not occur, it is difficult to perform sealing the gaps in the radial direction of the compressor chamber 5, and the gas in the chamber 5 leaks to the side of the intake port through the gap C or C'. When the gas in the compression chamber 5 leaks at the downstream side, the quantity of the gas to be discharged through the outlet port 8 is decreased whereby volumetric efficiency decreases. This results in recompression of a part of the gas leaked thereby causing increase in power input to the motor and decreasing a coefficient of performance.

In order to eliminate the above-mentioned difficulty, there has been proposed a method of sealing the radial gap in the radial direction wherein $(d_1+d_2)$ is determined greater than $(B-2r-t)$ in the equation (2). However, in practice, there is scatter in values in accuracy of machining of the width of groove B, the quantity of eccentricity r and the thickness of the wraps d. Accordingly, the value $(B-2r-t)$ indicates a value obtained by summing each scattered value. Accordingly, it is necessary to determine sufficiently large values for the gaps $d_1$ and $d_2$ in order to always make the value $(d_1+d_2)$ greater than the value $(B-2r-t)$ at any position of rotation of the crank shaft. On the other hand, the optimum value is given to the gaps in the bearing $d_1$ and $d_2$ so that function of lubrication as the primary object can be satisfactorily performed. Accordingly, if the gaps in the bearing portion is made unnecessarily large, the function of lubrication may be impaired. It is, therefore, necessary to increase accuracy in machining of the width B, the quantity of eccentricity r and the thickness t. Further, if the position of the center O of the stationary scroll member 1 or the axial center $O_1$ of the main bearing 17 is unexpectedly deflected, there happens that the gap C is not equal to the gap $C_1$ (FIG. 11*a*), and in an extreme case, only either one is greater than the other, whereby the gaps C and $C_1$ are not made 0 even though the optimum gaps $d_1$, $d_2$ are given.

Accordingly, it is necessary that accuracy in assembling the stationary scroll member 1 with respect to the axial center $O_1$ of the main bearing 17 is increased.

Japanese Unexamined Patent Publication No. 162383/1984 proposes a way to eliminate the above-mentioned disadvantage. Namely, an eccentric bush having a bearing portion, the center of which is eccentric at a predetermined amount, is fitted in an eccentric recess formed in the crank shaft 14 and an oscillating scroll shaft is fitted in the bearing portion of oscillating movement, whereby the actual width for oscillation D for the oscillatable scroll member 2 can be varied as desired while the gap in the radial direction of the compression chamber 5 is rendered to be 0. The technique proposed in the publication will be briefly described with reference to FIGS. 13*a*, 13*b*, 14*a* and 14*b*. FIG. 13*b* shows a state that an eccentric bush 26 is rotatably fitted in an eccentric recess 16' formed in the crank shaft 14 and the oscillatable scroll shaft 4 is rotatably fitted into the bearing portion of oscillating movement 16'' formed in the eccentric bush 26 with the quantity of eccentricity. FIG. 13*a* is a cross-sectional view of FIG. 13*b*. FIGS. 14*a* and 14*b* show operations of the important part of the eccentric bush and the bearing portion. FIG. 14*a* shows a state that the wrap of the stationary scroll member 1 is slightly shifted toward the center of the scroll member due to scatter in machining or assembling, hence the oscillatable scroll member 2 is also shifted to the center, whereby the bush 26 is counterclockwisely rotated and the radius of oscillating movement R' is small. FIG. 14*b* shows a state that the wrap of the stationary scroll 1 is slightly shifted away from its center. In this case, the oscillatable scroll member 2 causes the eccentric bush 26 to rotated clockwisely due to a force F acting on itself and is in contact with the stationary scroll member 1 in the radial direction. Thus, with the eccentric bush, it is possible to always perform sealing in the radial direction of the compression chamber. However, in fact, since the force F imparted by the oscillatable scroll shaft 4 acts on the eccentric bush 26, a frictional force (not shown) is produced between the outer circumference of the eccentric bush 26 and the eccentric recess 16'. Accordingly, a resistance of friction is against the sliding movement of the outer circumference of the eccentric bush and it tends to block the rotation of the eccentric bush. If coefficient of friction between the outer circumference of the eccentric bush 26 and the eccentric recess 16' becomes excessive due to material of the bush to be used, accuracy in machining, condition of oil supply, etc., the eccentric bush is prevented from free rotation, and, as a result, there occurs operations under the condition that the wrap of the stationary scroll member is not in contact with the wrap of the oscillatable scroll member, hence sealing in the radial direction of the compression chamber 5 can not be established, whereby coefficient of performance is decreased as described before.

If the coefficient of friction is not so large and the compressor is operated under the condition that the wrap of the stationary scroll member is in contact with the wrap of the oscillatable scroll member, a load of contact $F_s$ will act on the contacting point between the wraps of the stationary and oscillable scroll members owing to a moment of rotation which is resulted by a force F' as shown in FIG. 14*a*. The load of contact $F_s$ constitutes a force of resistance against the sliding movement of the wrap of the oscillatable scroll member to the wrap of the stationary scroll member. The resisting force requires an additional input power in the operations of the compressor thereby reducing coefficiency of performance.

Japanese Examined Publication No. 28433/1983 has proposed a technique to solve the problem on the above-mentioned eccentric bush. The publication discloses a scroll-type compressor having a crank shaft provided with a fitting plate in an eccentric form and a oscillatable link engaged with a pivot pin attached to the fitting plate, wherein an oscillatable scroll member is fitted to a bushing provided at an end of the oscillatable link. In such scroll-type compressor, a resistance of friction produced at the time of oscillating movement of the oscillatable link becomes extremely small since the link is engaged with the pivot pin having a relatively small diameter. Accordingly, the oscillatable scroll member is movable in the radial direction so as to be in contact with the stationary scroll member to thereby establish sealing in the radial direction. However, in such scroll-type compressor, while the crank shaft bears a load from the oscillatable scroll member through the oscillatable link and the pivot pin, a bearing for supporting a main shaft is in a position shifted from the axial direction. Accordingly, the crank shaft will receive a large moment, whereby a large load is imparted to the bearing, resulting in occurrence of burning of the bearing.

Thus, the conventional scroll-type compressor has the drawback that it is difficult to perform sealing of the gap in the radial direction of the compression chamber thereby causing reduction in volumetric efficiency, hence reduction in coefficient of performance. Further, in the conventional scroll-type compressor using the eccentric bush to seal the compression chamber, it is difficult to obtain stable sealing due to a friction produced in the outer circumference of the eccentric bush to thereby also cause reduction in the volumetric efficiency.

OBJECTS OF THE INVENTION

It is an object of the present invention to provide a scroll-type fluid transferring machine capable of providing sufficient sealing of a gap in the radial direction of a compression chamber and having excellent volumetric efficiency and coefficient of performance and being highly reliable.

It is another object of the present invention to provide a scroll-type fluid transferring machine capable of providing sealing of a gap in the radial direction of the compression chamber and minimizing production of a frictional resistance between the wrap of an oscillatable scroll member and the wrap of a stationary scroll member and having excellent volumetric efficiency and coefficient of performance.

SUMMARY OF THE INVENTION

According to the present invention, there is provided a scroll-type fluid transferring machine which comprises a stationary scroll member and an oscillatable scroll member, each of which has a spiral wrap of an involute curve or other curves projecting from a base plate and which cooperate to form a compression chamber between the spiral wraps and the base plates by mutually fitting one into the other, an oscillatable scroll shaft provided on the surface of the base plate at the position opposite the spiral wrap of the oscillatable scroll member, a crank shaft having an eccentric recess having its axis which is shifted by a predetermined distance from the axis of the crank shaft, the eccentric recess receiving the shaft of the oscillatable scroll member to cause an oscillating movement of the oscillatable scroll member, a main bearing for rotatably supporting the crank shaft, a bearing supporter for supporting the main bearing, and means for preventing the rotation of the oscillatable scroll member which prevents the rotation of the oscillatable scroll member around the axis of the shaft and causes an oscillating movement of the oscillatable scroll member with respect to and inside the main bearing, wherein a cylindrical bush having the coaxial outer and inner circles is loosely fitted in the eccentric recess of the crank shaft with a gap between the outer circumference of the bush and the inner wall of the eccentric recess, and the shaft of the oscillatable scroll member is fitted in the inner circumference of the bush in a freely rotatable manner.

According to another aspect of the present invention, there is provided a scroll-type fluid transferring machine in which a cylindrical bush having coaxial outer and inner circumferences is loosely fitted in an eccentric recess formed in a crank shaft with a predetermined gap and the quantity of eccentricity of the crank shaft is so determined that the gap between the wraps of the oscillatable and stationary scroll members is substantially zero during operation, and at the same time, a pushing force by the wrap of the oscillatable scroll member to the wrap of the stationary scroll member is not produced.

BRIEF DESCRIPTION OF THE DRAWINGS

FIGS. 11*a* and 11*b* are respectively a longitudinal cross-sectional view and a transverse cross-sectional view of an important part of the conventional scroll-type compressor;

FIG. 12 is a transverse cross-sectional view similar to FIG. 11*b* in a state that a load for compression of gas acts on the oscillatable scroll shaft;

FIGS. 14*a* and 14*b* are respectively cross-sectional views showing function of the conventional scroll-type compressor shown in FIGS. 13.

DETAILED DESCRIPTION OF THE PREFERRED EMBODIMENTS

Figure 1:
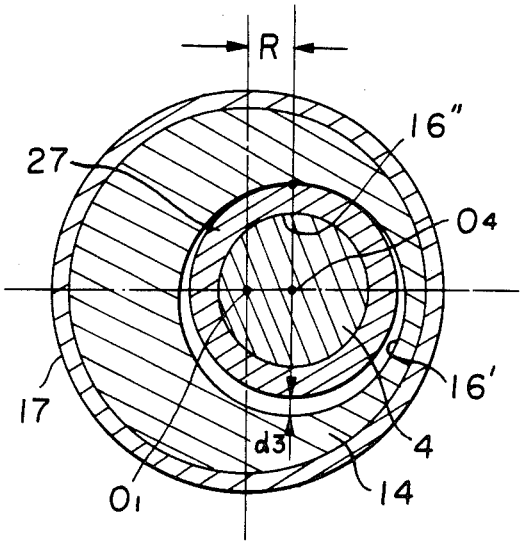
FIGS. 1*a* and 1*b* are respectively a transverse cross-sectional view and a longitudinal cross-sectional view of an important part of the scroll-type fluid transferring machine according to an embodiment of the present invention.
Figure 1:
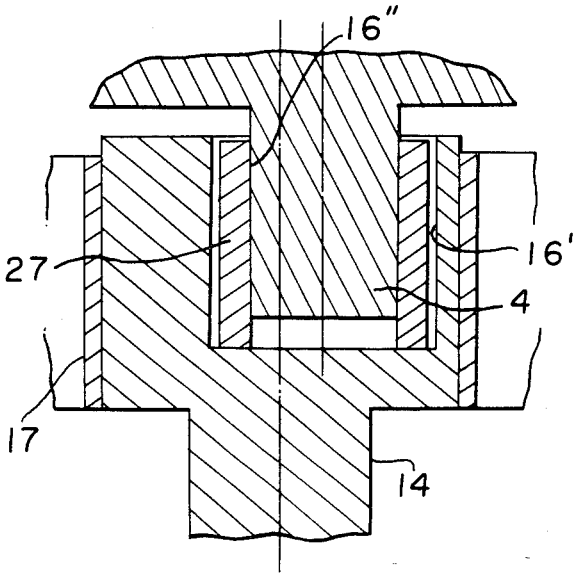
Figure 2:
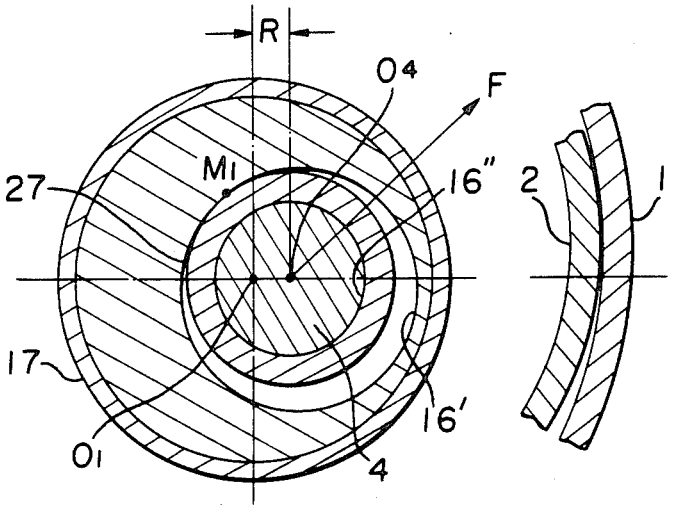
FIGS. 2*a* and 2*b* are cross-sectional views showing function of the fluid transferring machine in FIG. 1.
Figure 2:
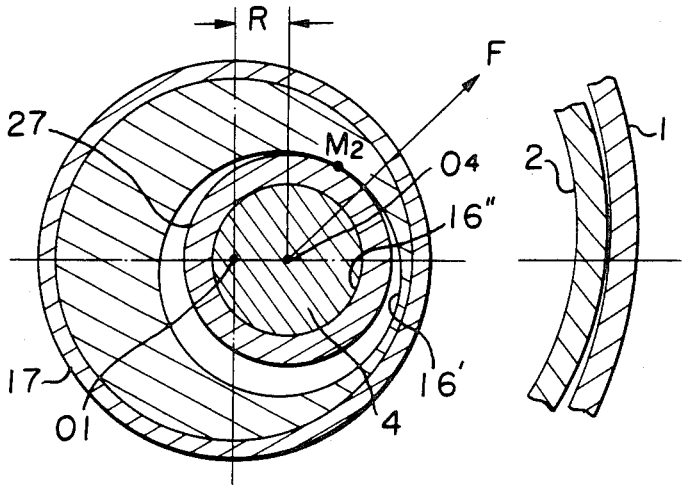
Figure 3:
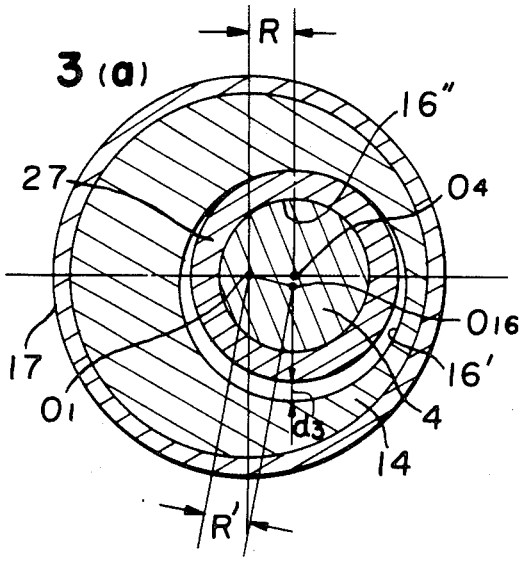
FIGS. 3*a* and 3*b* are respectively a transverse cross-sectional view and a longitudinal cross-sectional view of the scroll-type fluid transferring machine according to another embodiment of the present invention.
Figure 3:
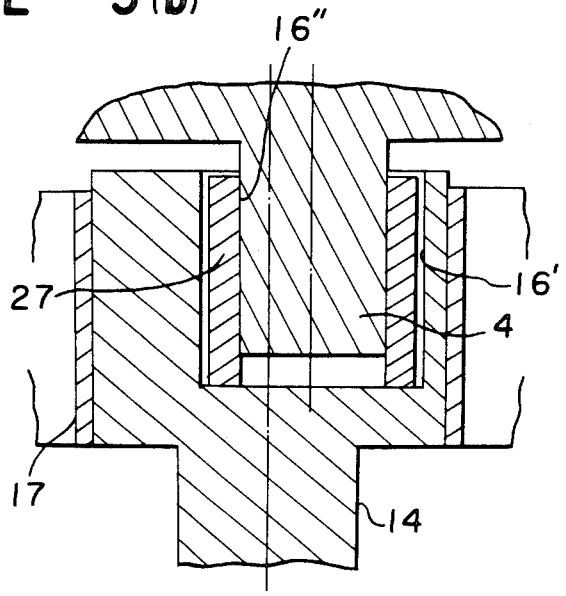

A first embodiment of the present invention will be described with reference to FIGS. 1*a* and 1*b* and FIGS. 2*a* and 2*b*. FIGS. 1*a* and 1*b* correspond to FIGS. 13*a* and 13*b* and FIGS. 2*a* and 2*b* correspond to FIGS. 14*a* and 14*b*. In the Figures the same reference numerals designate the same or corresponding parts. A reference numeral 16' designates an eccentric recess formed in the crank shaft 14 with a predetermined amount of eccentricity, a numeral 27 designates a cylindrical bush made of a bearing material which is fitted into the eccentric recess 16', a numeral 16" designates a bearing portion as the inner circumferential surface which has the same axial center as the outer circumference of the bush 27, a symbol $d_3$ refers to a gap formed between the outer circumference of the bush 27 and the inner wall of the eccentric recess 16', a symbol $O_1$ represents the axial center of the main bearing 17, a symbol $O_4$ represents the axial center of the oscillatable scroll shaft 4, and a symbol R indicates the distance between $O_1$ and $O_4$, namely, a radius of oscillating movement of the oscillatable scroll shaft 4. The other reference numerals as in FIGS. 1 and 2 are the same as those in FIGS. 11 and 13, and, therefore, description is omitted. In FIGS. 1*a* and 1*b* or FIGS. 13*a* and 13*b*, there are in fact gaps between the main bearing 17 and the crank shaft 14 and between the bearing portion 16" and the oscillatable scroll shaft 4; however, the gaps are omitted in the drawing.

In the embodiment of the present invention having the above-mentioned construction, the bush 27 can be moved within the gap $d_3$ since there exists the gap $d_3$ around the outer circumference of the bush 27. Namely, the radius of oscillating movement R is variable within the gap $d_3$. The movement of the bush 27 will be described with reference to FIGS. 2*a* and 2*b*. FIG. 2*a* shows a state that the wrap of the stationary scroll member 1 is slightly shifted toward the center of the scroll member 1 due to permissible errors in machining and assembling. A symbol F refers to a resultant force of the centrifugal force Fc and the load for gas compression Fg as described before, which is a force acting substantially on the bearing portion 16" for oscillating movement. When the vector F acts on the bearing portion, the eccentric bush 27 tends to move in the direction that the radius of oscillating movement R becomes large. However, the eccentric bush 27 is made standing still at a position where the wrap of oscillatable scroll member is in contact with the wrap of the stationary scroll member. A symbol $M_1$ designates a contacting point between the outer circumference of the eccentric bush 27 and the eccentric recess 16'.

FIG. 2*b* shows a state that the wrap of the stationary scroll member 1 is shifted slightly outward. Even in such state, the resultant force F moves the eccentric bush to a position that the radius of oscillating movement R becomes large and moves the wrap of the oscillatable scroll member 2 to a position in contact with the wrap of the stationary scroll member 1. In this case, the contacting point of the outer circumference of the eccentric bush 27 to the eccentric recess 16' is $M_2$. The displacement of the contacting point of the bush 27 to the eccentric recess 16' from $M_1$ to $M_2$ or from $M_2$ to $M_1$ may be done by a sliding movement between the outer circumferential surface of the bush 27 and the inner circumferential surface of the eccentric recess 16', or a rolling movement of the bush 27 on the inner circumferential surface of the eccentric recess 16'. Generally, the above-mentioned displacement may be done by the rolling movement since a resistance in the rolling movement is far smaller than that in the sliding movement. Accordingly, in the present invention, the problem that the bush 27 can not follow in the radial direction of the oscillatable scroll member 2 due to a large resistance of friction produced between the eccentric bush and the eccentric recess, as encountered in the conventional scroll-type compressor, is eliminated, and it is possible that the wraps of the stationary and oscillatable scroll members 1, 2 are always in contact with each other owing to the rolling movement of the bush 27.

Thus, in the embodiment of the present invention, the wrap of the oscillatable scroll member 2 always follows the wrap of the stationary scroll member 1 so as to be in contact with it during the operations of the compressor regardless of the position of the wrap of the stationary scroll member 1, whereby sealing function in the radial direction of the compression chamber 5 is assured. Accordingly, an amount of gas leaking from the compression chamber 5 is reduced to thereby increase volumetric efficiency. Unnecessary input power for the motor caused by recompression of the leaked gas can be eliminated and coefficient of performance is remarkably increased. In this case, the gap $d_3$ is determined in consideration of the scatter of machining and assembling to comply with the quantity of variation of the radius of oscillating movement R.

In the above-mentioned embodiment, the bush 27 and the main bearing 17 are arranged at substantially the same position in the axial direction of the crank shaft, whereby the main bearing does not receive any moment by the force F transmitted from the oscillatable scroll shaft 4, and a force of reaction of the main bearing can be minimum thereby to increase reliability.

Thus, the scroll-type compressor having the above-mentioned construction increases efficiency and reliability.

In the foregoing, description has been made as to the scroll-type compressor as an example. The similar effect can be obtained even when the present invention is utilized in an apparatus such as an expansion machine.

In the next place, a second embodiment as modification of the embodiment shown in FIGS. 1 and 2 will be described with reference to FIGS. 3, 4, 5, 6, 7 and 8. In the FIGS. 3*a* and 3*b*, a symbol $O_{16}$ designates the center of the eccentric recess 16' and a symbol R' designates the quantity of eccentricity of the center $O_{16}$ of the eccentric recess 16' to the axial center $O_1$ of the main bearing 17. The other reference numerals designate the same parts and positions as shown in FIGS. 1 and 2, and, therefore, description of these parts and positions is omitted.

In the scroll-type compressor having the above-mentioned construction according to the present invention, the quantity of eccentricity R' of the eccentric recess 16' is so determined that the gap C' in the radial direction of the wraps of the oscillatable and stationary scroll members is zero during the operation of the compressor, and at the same time, any contacting force is not produced between them. The effect obtained by the determination of eccentricity will be described with reference to FIGS. 4 to 8.

Figure 4:
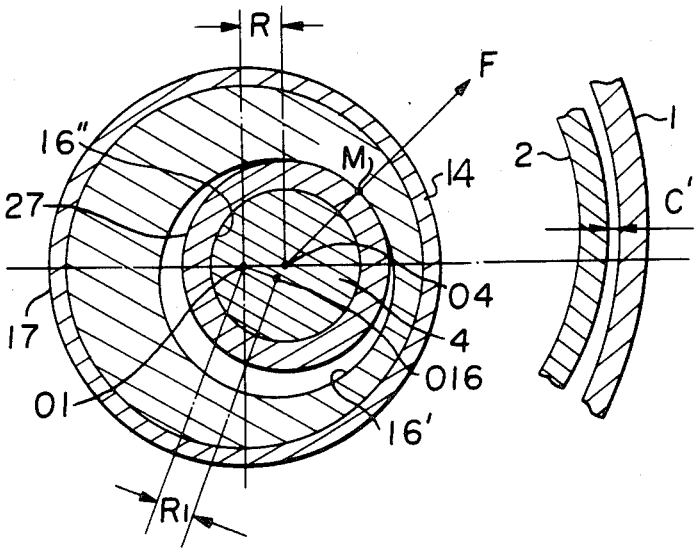
FIGS. 4, 5 and 6 are respectively cross-sectional views showing function of the fluid transferring machine shown in FIG. 3.
Figure 5:
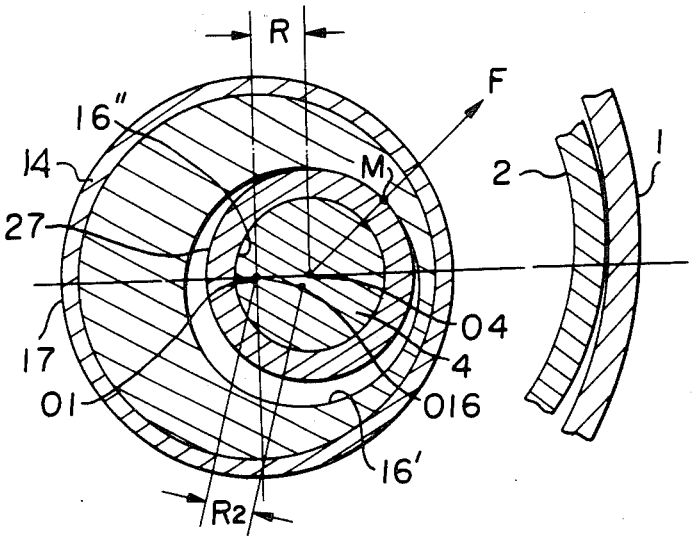
Figure 6:
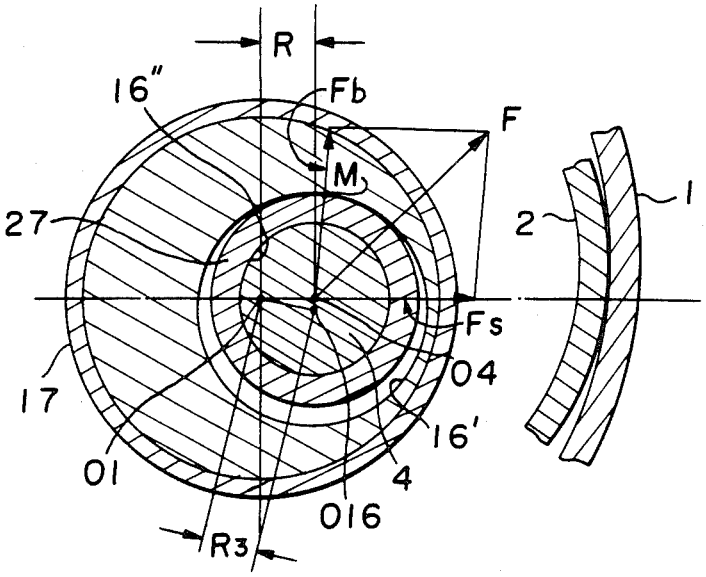

In FIGS. 4, 5 and 6, a symbol F designates a resultant force composed by the centrifugal force acting on the oscillatable scroll member 2 and a load for compressing gas acting on the oscillatable scroll member 2 (which is the same as shown in FIG. 12), and a symbol M is a contacting point where the eccentric bush 27 is pushed to the inner circumference of the eccentric recess 16' by the resultant force F.

FIG. 4 shows a state that the quantity of eccentricity R' assumes a smaller value $R_1$ and the contacting point M is on the line of action of the resultant force F with the consequence that a gap C' in the radial direction exists between the wraps of the stationary and oscillatable scroll members. In this case, the resultant force F entirely acts on the crank shaft 14 at the contacting point M.

FIG. 5 shows a state obtained by the present invention that the quantity of eccentricity R' assumes the optimum value $R_2$ and the gap C' in the radial direction is zero even though the contacting point M is on the line of action of the resultant force F. In this case, any contacting force is not produced between the wraps of the stationary and oscillatable scroll members while the resultant force F entirely acts on the crank shaft 14 at the contacting point M.

FIG. 6 shows a state that the quantity of eccentricity R' assumes further large value $R_3$ and the contacting point M is out the line of action of the resultant force F wherein the gap C' in the radial direction is zero, namely, the wrap of the stationary scroll member 1 comes in contact with the oscillatable scroll member 2. In this case, the resultant force F from the oscillatable scroll member 2 is divided into a component force Fb acting on the crank shaft and a component force Fs acting on the wrap of the stationary scroll member. The component Fs constitutes a contacting force of the wrap of the oscillatable scroll member 2 to the wrap of the stationary scroll member 1.

Figure 7:
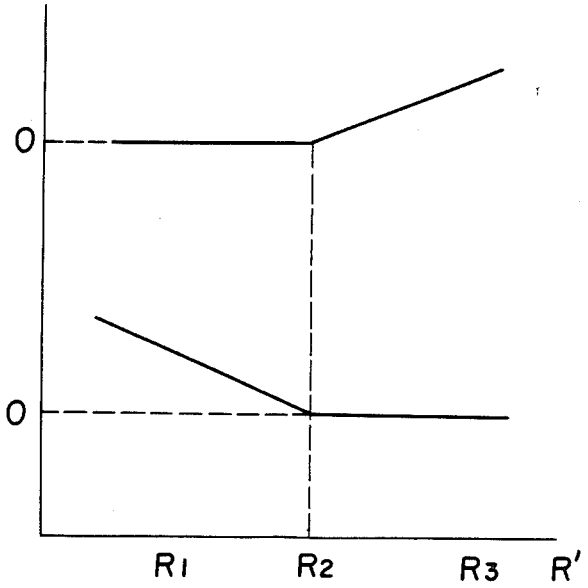
FIGS. 7 and 8 are respectively graphs showing effect of the embodiment shown in FIGS. 3*a* and 3*b*.

FIG. 7 shows how the gap C' and the contacting force Fs vary depending on the magnitude of the quantity of eccentricity R'. As shown in FIG. 7, when the quantity of eccentricity is smaller than $R_2$, the contacting force Fs becomes zero while the gap in the radial direction C' increases. In this case, although a force of resistance due to the contact between the wraps of the stationary and oscillatable scroll members does not cause increase in a input power for the compressor, the gap in the radial direction of the compression chamber 5 increases resulting in leakage of gas, hence causing increase in an input power for the compressor owing to the compression of the leaked gas. Increase in the input power becomes greater as the quantity of eccentricity R' becomes smaller.

Figure 8:
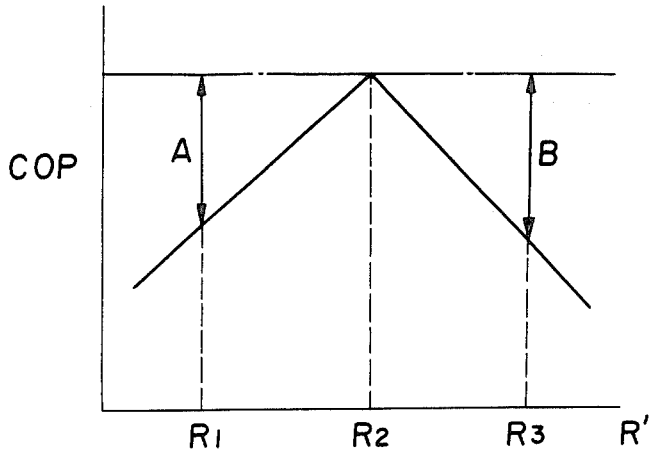
Figure 9:
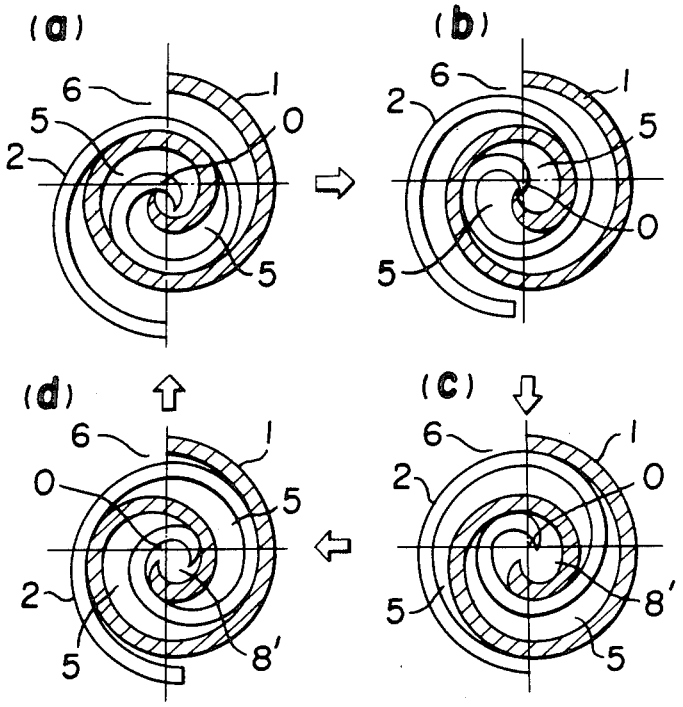
FIGS. 9*a* to 9*d* are diagrams showing the principle of a typical scroll-type compressor.
Figure 10:
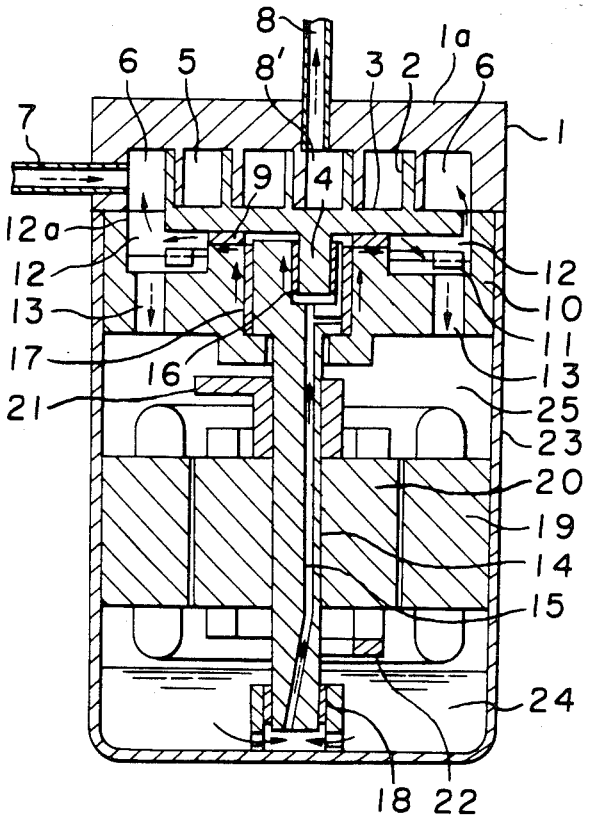
FIGURE 10 PRIOR ART
FIG. 10 is a longitudinal cross-sectional view showing the whole construction of a conventional scroll-type compressor.
Figure 13:
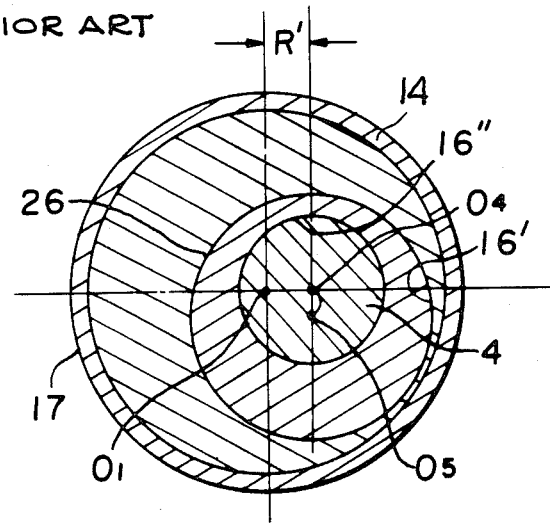
FIGURE 13 (a) PRIOR ART
FIGS. 13*a* and 13*b* are respectively a transverse cross-sectional view and a longitudinal cross-sectional view of a conventional scroll-type compressor in which an eccentric bush is used.
Figure 13:
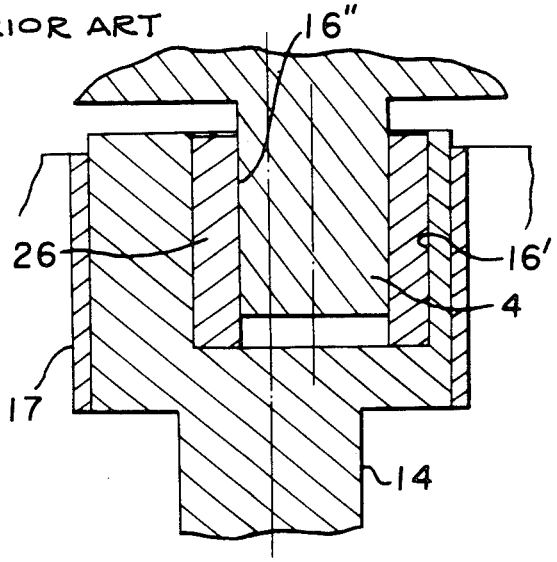
FIGURE 13 (b) PRIOR ART

When the quantity of eccentricity R' is greater than $R_2$, the gap in the radial direction in the compression chamber becomes zero while the contacting force Fs increases. In this case, although there is no increase in an input power for the compressor because of leakage of the gas in the radial direction of the compression chamber 5, a force of resistance caused by the contact between the wraps of the stationary and oscillatable scroll members increases, hence an input power for the compressor increases. The input power for the compressor increases as R' increases. From the above-mentioned characteristics, coefficient of performance (COP) of the compressor indicates tendency as shown in FIG. 8, wherein the quantity of eccentricity is the maximum at $R_2$ and COP decreases if the quantity of eccentricity is greater than or smaller than $R_2$.

As above-mentioned, the coefficient of performance of the compressor can be made maximum by determining the quantity of eccentricity R' to be $R_2$, namely, by determining the gap in the radial direction between the wraps of the stationary and oscillatable scroll members to be zero, and at the same time, a contacting force produced in the wraps of the both members to be zero. It is, of course, difficult to determine an ideal quantity of eccentricity in a practical compressor because there are more or less scatter in machining of the wraps of the scroll members and scatter in the assembling work. In the present invention, however, even though there are the scatter in dimensions, the position of the contacting point M (FIG. 5) is not largely deflected from the line of action of the resultant force F by contriving in such a manner that the gap $d_3$ formed around the outer circumference of the bush 27 is made greater to some extent, whereby the contacting force produced in the wraps of the scroll members is negligible. Further, there is possibility that the gap in the radial direction between the wraps of the scroll members increases in the scatter in machining operations. However, no problem will occur from the viewpoint of performance of the compressor. Accordingly, the coefficient of performance in a practical compressor assumes a point extremely close to the highest point in FIG. 8.

As described before, in the embodiment shown in FIG. 3, the contacting force $F_s$ and the gap C' between the wraps of the stationary and oscillatable scroll members can be controlled to have a desired value (i.e., a value at or near the value of $R_2$ in FIG. 7) because the gap $d_3$ in FIG. 3 has a relatively large value, even though there are relatively large scattering in dimensions of the wraps of the both members when they are machined and assembled. However, if the wraps of the both scroll members can be finely machined and errors in the assembling works of the scroll members can be minimized, the same effect as in the embodiment in FIG. 1 can be attained even though the gap $d_3$ is made extremely small. In some cases, the gap $d_3$ may be zero.

Figure 15:
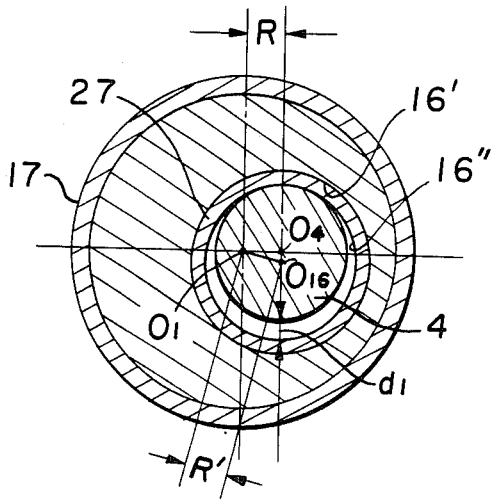
FIGS. 15*a* and 15*b* are respectively cross-sectional views of the scroll-type fluid transferring machine according to still another embodiment of the present invention.
Figure 15:
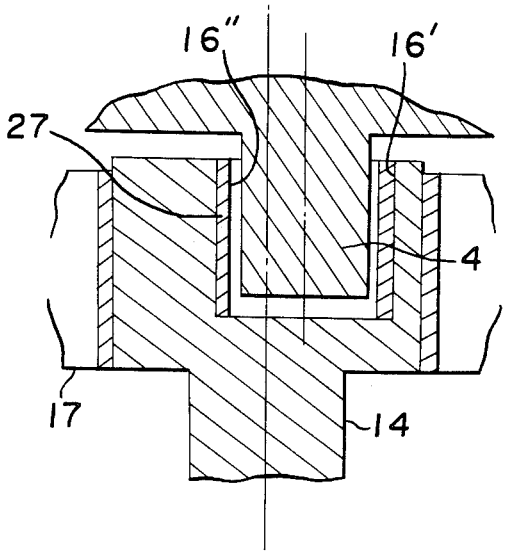

FIGS. 15*a* and 15*b* are diagrams of a third embodiment of the present invention in which the gap $d_3$ is zero. The same reference numerals as in FIG. 1 designate the same or corresponding parts and description of these parts is, therefore, omitted.

In the figures, there exists no gap $d_3$ in a substantial quantity as in FIG. 1, but there is a gap $d_1$ as a bearing gap. Such gap $d_1$ is, in fact, formed in the first embodiment in FIG. 1; however, it is neglected in the figure because the gap $d_1$ is relatively smaller than the gap $d_3$.

In this case, change in the radius of oscillating movement in the first embodiment is extremely small because the wraps of the both scroll members are accurately machined and assembled. Accordingly, the purpose of the present invention can be sufficiently attained by providing only the bearing gap $d_1$.

In the embodiments of the present invention, noise in the operations of the compressor can be minimized in comparison with the conventional one in which a contacting force is produced between the wraps of the scroll members, because the contacting force between the wraps is nearly zero. Thus, in accordance with the present invention, a scroll-type compressor of high performance, small noises and high reliability can be provided.

What is claimed is:

1. A scroll-type fluid transferring machine which comprises:

(a) a stationary scroll member and an oscillatable scroll member each of which has a spiral wrap of an involute curve or other curves projecting from a base plate, said stationary scroll member and said oscillatable scroll member cooperating to form a compression chamber between the spiral wraps and the base plates by mutually fitting one into the other;

(b) an oscillatable scroll shaft provided on the surface of the base plate of said oscillatable scroll member at the position opposite the spiral wrap of said oscillatable scroll member;

(c) a crank shaft having an axis and having an eccentric recess, said eccentric recess having an axis which is shifted by a predetermined distance from the axis of said crank shaft, said eccentric recess receiving said oscillatable scroll shaft to cause an oscillating movement of said oscillatable member;

(d) at least one main bearing for rotatably supporting said crank shaft;

(e) a bearing supporter for supporting said main bearing;

(f) means for preventing the rotation of said oscillatable scroll member around the axis of said oscillatable scroll shaft and for causing the oscillating movement of said oscillatable scroll member with respect to and inside of said at least one main bearing; and (g) a cylindrical bush having coaxial outer and inner circumferences loosely fitted in said eccentic recess in said crank shaft with a gap between the outer circumference of said cylindrical bush and the inner wall of said eccentric recess, said oscillatable scroll shaft being fitted in the inner circumference of said cylindrical bush in a freely rotatable manner.

2. A scroll-type fluid transferring machine according to claim 1, wherein said at least one main bearing is placed at substantially the same position as said cylindrical bush in the longitudinal direction of said crank shaft.

3. A scroll-type fluid transferring machine according to claim 1, wherein the quantity of eccentricity of said eccentric recess is determined so that, during operation of the machine, the gap between the wrap of said oscillatable scroll member and the wrap of said stationary scroll member becomes substantially zero and a pushing force between the wrap of said oscillatable scroll member and the wrap of said stationary scroll member is not produced.

4. A scroll-type fluid transferring machine according to claim 1, wherein the axis of said oscillatable scroll shaft and the axis of said eccentric recess are intentionally spaced from one another.

5. A scroll-type fluid transferring machine according to claim 1, wherein the outer circumference of said cylindrical bush makes rolling contact with the inner circumference of said eccentric recess.

6. A scroll-type fluid transferring machine according to claim 1, wherein the outer circumference of said cylindrical bush makes sliding contact with the inner circumference of said eccentric recess.

* * * * *